US007549898B2

(12) United States Patent
Waltz

(10) Patent No.: US 7,549,898 B2
(45) Date of Patent: Jun. 23, 2009

(54) WATERPROOF ELECTRICAL CONNECTOR

(75) Inventor: Peter A. Waltz, Bristol, NH (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/904,355

(22) Filed: Sep. 26, 2007

(65) Prior Publication Data

US 2009/0081897 A1 Mar. 26, 2009

(51) Int. Cl.
*H01R 11/09* (2006.01)

(52) U.S. Cl. ..... 439/796

(58) Field of Classification Search ..... 439/276, 439/901, 709, 723, 475, 796, 801, 797; 174/71, 174/88, 99; 137/516.29, 516.27; 474/110
See application file for complete search history.

(56) References Cited

U.S. PATENT DOCUMENTS

| | | | | |
|---|---|---|---|---|
| 3,350,677 | A * | 10/1967 | Daum | 439/587 |
| 3,580,275 | A * | 5/1971 | Hanson et al. | 137/516.29 |
| 3,624,594 | A | 11/1971 | Trimble et al. | 339/116 C |
| 3,976,216 | A * | 8/1976 | Lambert | 215/307 |
| 4,044,809 | A * | 8/1977 | Guerrico Echevarria | 411/276 |
| 4,046,958 | A | 9/1977 | Lusk | 174/73 R |
| 4,223,179 | A | 9/1980 | Lusk et al. | 174/73 R |
| 4,260,213 | A | 4/1981 | Kotski et al. | 339/111 |
| 4,524,800 | A * | 6/1985 | Holland | 137/516.27 |
| D346,150 | S | 4/1994 | Triantopoulos | D13/149 |
| 5,584,409 | A * | 12/1996 | Chemberlen | 220/89.1 |
| 5,732,771 | A | 3/1998 | Moore | 166/65.1 |
| 6,435,993 | B1 * | 8/2002 | Tada | 474/110 |
| 6,475,029 | B2 | 11/2002 | Tucker et al. | 439/521 |
| 6,764,354 | B2 | 7/2004 | Kaine et al. | 439/793 |
| 6,854,996 | B2 * | 2/2005 | Yaworski et al. | 439/276 |
| 7,037,128 | B2 | 5/2006 | Yaworski et al. | 439/276 |
| 7,090,532 | B1 | 8/2006 | Kaine | 439/523 |
| 7,097,515 | B2 | 8/2006 | Siddiqi et al. | 439/700 |
| 7,201,596 | B1 | 4/2007 | Bukovnik et al. | 439/276 |

FOREIGN PATENT DOCUMENTS

| | | |
|---|---|---|
| JP | 2000-228243 | 8/2000 |

* cited by examiner

*Primary Examiner*—Alexander Gilman
(74) *Attorney, Agent, or Firm*—Harrington & Smith, PC

(57) ABSTRACT

An electrical connector including a connector body having a plurality of conductor receiving areas; a plurality of set screws connected to the connector body for clamping conductors against the connector body in the conductor receiving areas; a seal casing on the connector body; and a valve on the connector body and in communication with at least one of the conductor receiving areas. The valve is configured to allow gas from inside the at least one conductor receiving area to vent out of the electrical connector.

20 Claims, 3 Drawing Sheets

WATERPROOF ELECTRICAL CONNECTOR

BACKGROUND OF THE INVENTION

1. Field of the Invention

The invention relates to an electrical connector and, more particularly, to a sealed set screw electrical connector.

2. Brief Description of Prior Developments

U.S. Pat. Nos. 6,764,354 B2 and 7,090,532 B1 disclose waterproof set screw electrical connectors. Existing set screw electrical connectors which are sealed, such as for underground use, suffer from two problems. First, during installation it is possible for the last seal being installed to pressurize the connector body such that the last seal or some other seal will not stay engaged in the connector body. Second, when the connector heats up, gases inside the sealed connector body expand forcing sealing caps and/or conductor seals to be forced out of the connector body. This allows water to leak into the connector. There is a desire to provided a sealed electrical connector which overcomes this problem.

SUMMARY OF THE INVENTION

In accordance with one aspect of the invention, an electrical connector is provided including a connector body having a plurality of conductor receiving areas; a plurality of set screws connected to the connector body for clamping conductors against the connector body in the conductor receiving areas; a seal casing on the connector body; and a valve on the connector body and in communication with at least one of the conductor receiving areas. The valve is configured to allow gas from inside the at least one conductor receiving area to vent out of the electrical connector.

In accordance with another aspect of the invention, an electrical connector is provided comprising a connector body comprised of electrically conductive material, a plurality of set screws, a seal casing on the connector body, a valve, and a plurality of caps. The connector body comprises a plurality of conductor receiving areas and at least one gas conduit connecting at least two of the conductor receiving areas to each other. The set screws are connected to the connector body for clamping conductors against the connector body in the conductor receiving areas. The valve is on the connector body and in communication with at least one of the conductor receiving areas. The valve is configured to allow gas from inside the at least one conductor receiving area to vent out of the electrical connector. The caps are configured to be inserted into set screw holes in the seal casing. The caps each comprise a valve configured to allow gas from inside the seal casing to vent out of the electrical connector.

In accordance with another aspect of the invention, a method of manufacturing an electrical connector is provided comprising providing a connector body comprised of electrically conductive material, wherein the connector body comprises a plurality of conductor receiving areas and at least one gas conduit connecting at least two of the conductor receiving areas to each other; connecting set screws to the connector body, wherein the set screws are configured to clamp conductors against the connector body in the conductor receiving areas; connecting a seal casing on the connector body; and connecting a gas vent to the connector body, wherein the gas vent is configured to vent gases from inside the connector body to outside the electrical connector.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
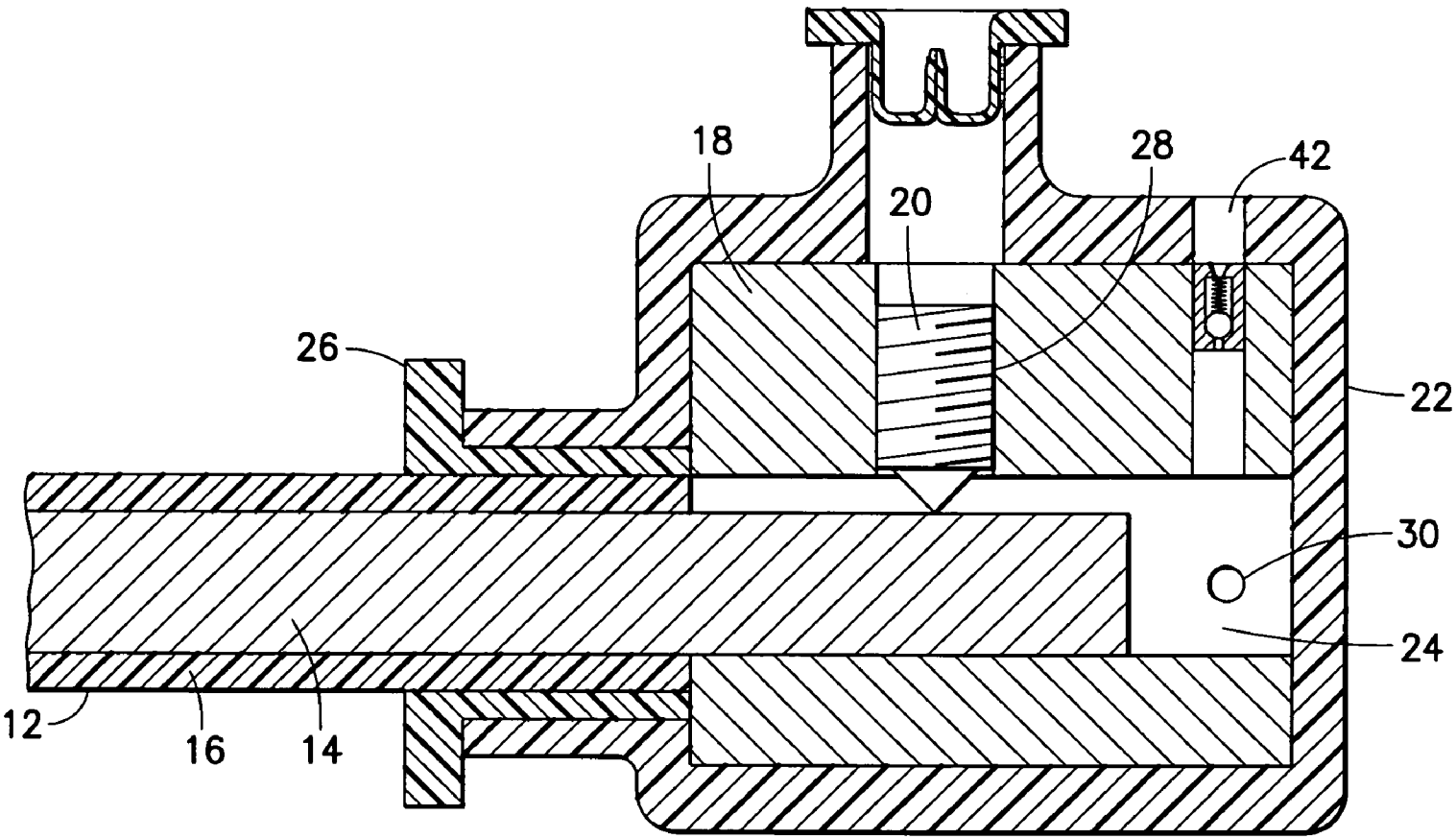
FIG. 1 is a cross sectional view of an electrical connector comprising features of the invention shown connected to an electrical conductor.

Referring to FIG. 1, there is shown a cross sectional view of an electrical connector 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

Figure 2:
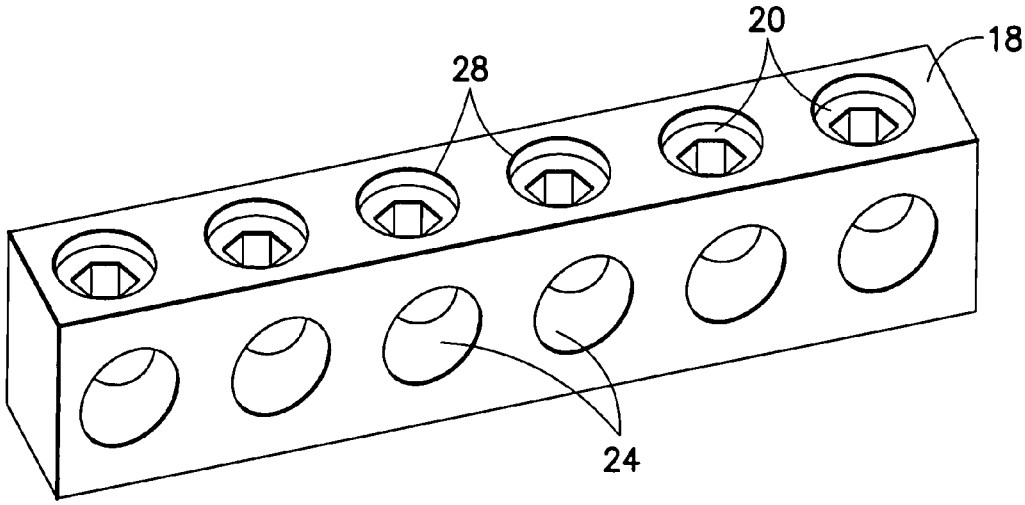
FIG. 2 is a perspective view of some of the components of the electrical connector shown in FIG. 1.

The connector 10 is shown in FIG. 1 connected to an electrical conductor 12 having a metal core 14 and an outer layer of insulation 16. Although only one conductor 12 is shown, the connector 10 actually has multiple conductors connected to it. Referring also to FIG. 2, the connector 10 generally comprises a connector body 18, set screws 20 and a seal casing 22. The connector body 18 comprises a one-piece metal member with a row of parallel conductor receiving areas 24 extending into a first side. The set screws 20 are connected to threaded holes 28 in a second side of the connector body 18. The threaded holes 28 intersect with the conductor receiving areas 24. In alternate embodiments, any suitable type of connector body and set screws could be provided. As seen in FIG. 1, the set screws 20 can be individually screwed into the connector body 22 to clamp the ends of the conductor cores 14 of the individual conductors against the connector body.

Figure 3:
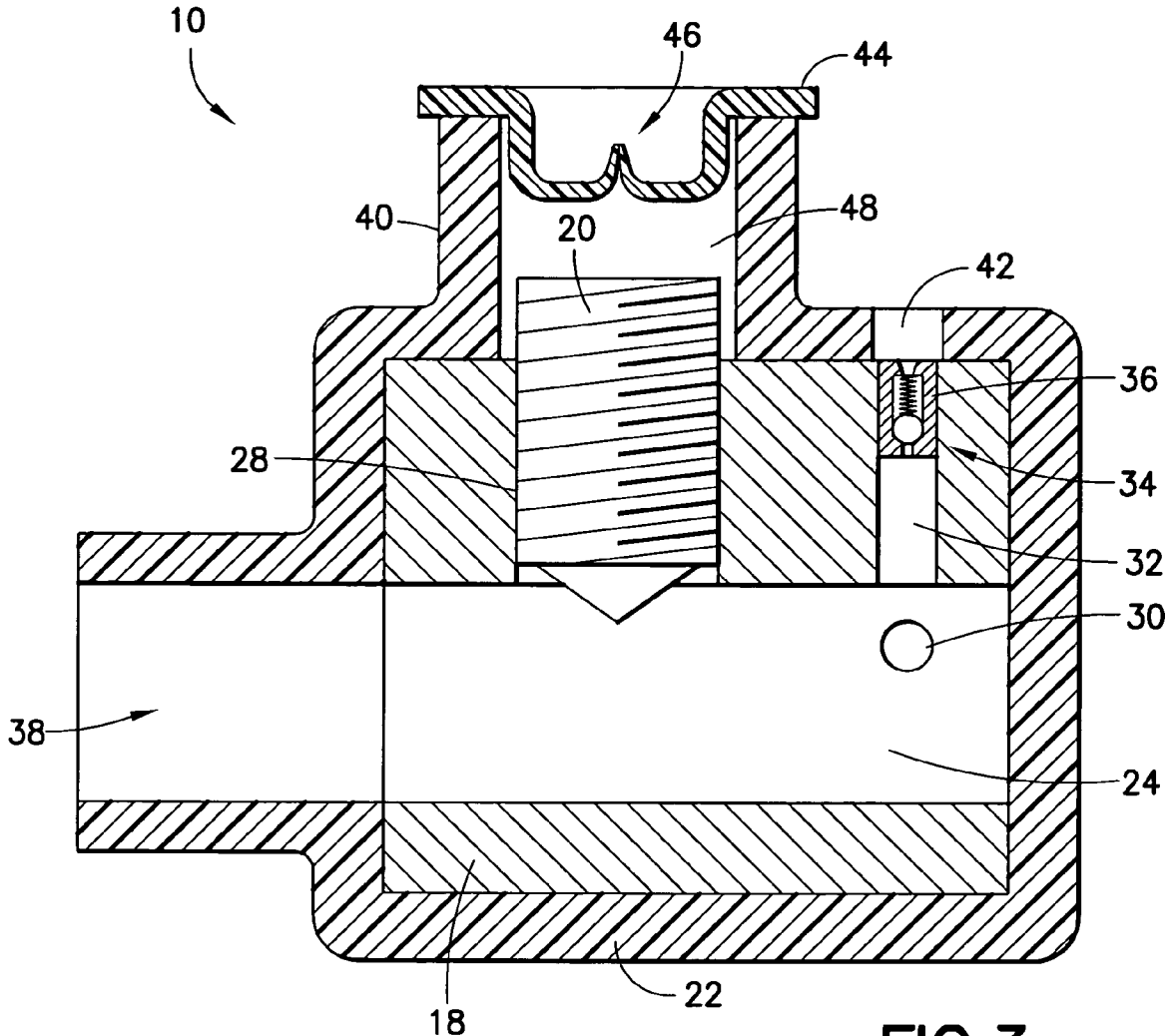
FIG. 3 is an enlarged cross sectional view of the electrical connector shown in FIG. 1.

Referring also to FIG. 3, the connector body 18 includes interconnection holes 30 which interconnect the conductor receiving areas 24 to each other. The interconnection holes 30 provide a gas path conduit between the conductor receiving areas 24. The connector body 18, in this embodiment, includes a gas vent 32. The gas vent 32 comprises a conduit 34 between one of the conductor receiving areas 24 and the exterior side of the connector body 18. The gas vent 32 includes a single check valve 36. The check valve 36 is located inside the conduit 34. The check valve 36 is a one-way valve configured to allow gas to exit from the conductor receiving area 24, but prevent water from entering into the conductor receiving area 24 in a reverse direction from outside the connector. In this embodiment the check valve 36 comprises a ball and a coil spring. However, in alternate embodiments, any suitable check valve could be provided. In addition, more than one check valve could be provided. In another alternate embodiment, the vent 32 might not be provided, such as when the seal caps 44 have check valves, as noted below, and the conductor receiving areas are in fluid communication with the areas 48.

The seal casing 22 is comprised of a plastic or polymer material. The seal casing 22 surrounds the outside of the connector body 18. The seal casing 22 includes conductor entrances 38 aligned at each of the conductor entrances to the conductor receiving areas 24, set screw entrances 40 aligned at each of the set screw holes 28, and a vent hole 42 aligned with the conduit 34. The connector 10 also includes sealing members 26. As seen in FIG. 1, the sealing members 26 are mounted on the insulation 16 of the conductors 12 to seal the conductor entrances 38 into the conductor receiving areas 24 with the seal casing 22.

The connector 10 also includes seal caps 44. The seal caps 44 are connected to the set screw entrances 40 of the seal casing 22 after the set screws 20 securely clamp the conductors 12. The seal caps 44 prevent water from entering the connector 10 through the entrances 40. In this embodiment, the caps 44 comprise check valves 46. In particular, the caps 44 are made of elastomeric material and the cap check valves comprise duck bill valves. However, in alternate embodiments, any suitable check valve could be provided. In one type of alternate embodiment, the caps might not comprise check valves, such as if a gas path is provided from the areas 48 to the conductor receiving areas 24 or the conduit 34. The cap check valves 46 allow gas to exit the connector from area 48, but prevent water from entering the connector 10 through the set screw entrances 40.

Figure 4:
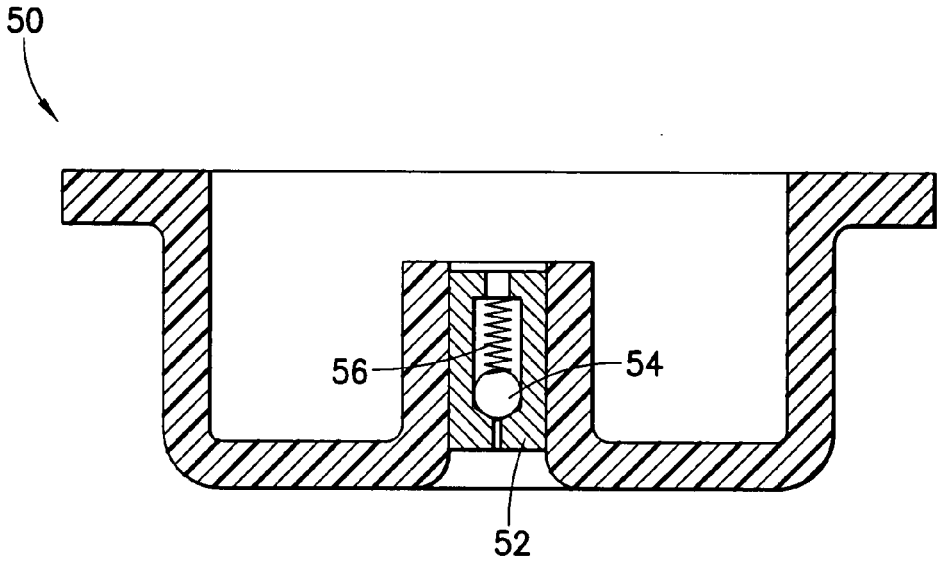
FIG. 4 is a cross sectional view of an alternate embodiment of a set screw entrance cap for the connector shown in FIGS. 1 and 3.

Referring also to FIG. 4, an alternate embodiment of a seal cap is shown. In this embodiment the seal cap 50 comprises a check valve 52 comprising a ball 54 and spring 56. However, as noted above, any suitable type of check valve could be provided.

The present invention can provide an underground or sealed electrical connector with a vent or check valve feature that will allow expanding gases, such as which are generated when the connector 10 becomes heated, to escape but nonetheless prevent water from entering into the sealed connector.

It should be understood that the foregoing description is only illustrative of the invention.

Various alternatives and modifications can be devised by those skilled in the art without departing from the invention. For example, features recited in the various dependent claims could be combined with each other in any suitable combination(s). Accordingly, the invention is intended to embrace all such alternatives, modifications and variances which fall within the scope of the appended claims.

What is claimed is:

1. An electrical connector comprising:

a connector body having a plurality of conductor receiving areas;

a plurality of set screws connected to the connector body for clamping conductors against the connector body in the conductor receiving areas;

a seal casing on the connector body; and a vent on the connector body and in communication with at least one of the conductor receiving areas, wherein the vent is configured to allow gas from inside the at least one conductor receiving area to vent out of the electrical connector and prevent water from entering the electrical connector through the vent.

2. An electrical connector as in claim 1 wherein the conductor receiving areas comprise a plurality of parallel conductor receiving areas aligned in at least one row.

3. An electrical connector as in claim 1 wherein the vent comprises a check valve in a valve conduit of the connector body.

4. An electrical connector as in claim 3 wherein the check valve comprises a coil spring and a ball.

5. An electrical connector as in claim 1 wherein the seal casing comprises a hole thought the seal casing which is in communication with the vent to allow gas to pass from the vent through the casing.

6. An electrical connector as in claim 1 wherein the seal casing comprises set screw holes to screw the set screws into the connector body, and the electrical connector comprises at least one cap configured to be inserted into at least one of the set screw holes in the seal casing, wherein the at least one cap comprises a valve configured to allow gas from inside the seal casing to vent out of the electrical connector.

7. An electrical connector as in claim 6 wherein the valve in the at least one cap comprises a check valve.

8. An electrical connector as in claim 7 wherein the check valve comprises a spring and a ball.

9. An electrical connector as in claim 6 wherein the valve in the at least one cap comprises a resiliently deflectable elastomeric valve.

10. An electrical connector as in claim 9 wherein the elastomeric valve comprises a duck bill valve.

11. An electrical connector comprising:

a connector body comprised of electrically conductive material, wherein the connector body comprises a plurality of conductor receiving areas and at least one gas conduit connecting at least two of the conductor receiving areas to each other;

a plurality of set screws connected to the connector body for clamping conductors against the connector body in the conductor receiving areas;

a seal casing on the connector body;

a valve on the connector body and in communication with at least one of the conductor receiving areas, wherein the valve is configured to allow gas from inside the at least one conductor receiving area to vent out of the electrical connector; and a plurality of caps configured to be inserted into set screw holes in the seal casing, wherein the caps each comprise a valve configured to allow gas from inside the seal casing to vent out of the electrical connector.

12. An electrical connector as in claim 11 wherein the conductor receiving areas comprise a plurality of parallel conductor receiving areas aligned in at least one row.

13. An electrical connector as in claim 12 wherein the valve comprises a check valve in a valve conduit of the connector body.

14. An electrical connector as in claim 13 wherein the check valve comprises a spring and a ball.

15. An electrical connector as in claim 14 wherein the seal casing comprises a hole thought the seal casing which is in communication with the valve to allow gas to pass from the valve through the casing.

16. An electrical connector as in claim 15 wherein the valves in the caps comprise check valves.

17. An electrical connector as in claim 16 wherein the check valves comprise a spring and a ball.

18. An electrical connector as in claim 16 wherein the check valves in the caps comprise a resiliently deflectable elastomeric valve.

19. An electrical connector as in claim 18 wherein the elastomeric valve comprises a duck bill valve.

20. A method of manufacturing an electrical connector comprising:

providing a connector body comprised of electrically conductive material, wherein the connector body comprises a plurality of conductor receiving areas and at least one gas conduit connecting at least two of the conductor receiving areas to each other;

connecting set screws to the connector body, wherein the set screws are configured to clamp conductors against the connector body in the conductor receiving areas;

connecting a seal casing on the connector body; and connecting a gas vent to the connector body, wherein the gas vent is configured to vent gases from inside the connector body to outside the electrical connector.

* * * * *